United States Patent [19]

Hayes

[11] 4,437,454

[45] Mar. 20, 1984

[54] MECHANICAL DRAFT CONTROLLER WITH VENT DAMPER

[75] Inventor: Thomas E. Hayes, Goshen, Ind.

[73] Assignee: Johnson Service Company, Milwaukee, Wis.

[21] Appl. No.: 360,166

[22] Filed: Mar. 22, 1982

[51] Int. Cl.[3] ..... F23N 3/06

[52] U.S. Cl. ..... 126/293; 236/1 G; 236/45

[58] Field of Search ..... 126/285 R, 292, 293, 126/307 A; 431/20; 236/1 G, 16, 45

[56] References Cited

U.S. PATENT DOCUMENTS

| | | | |
|---|---|---|---|
| 1,272,064 | 7/1918 | Lezius | 236/45 |
| 1,402,083 | 1/1922 | Morton | 236/45 |
| 2,346,825 | 4/1944 | Cole | 236/45 |
| 2,687,256 | 8/1954 | Puffer | 236/45 |
| 4,236,668 | 12/1980 | Prikkel, III | 236/1 G |

*Primary Examiner*—Lee E. Barrett

*Attorney, Agent, or Firm*—Emrich, Lee, Brown & Hill

[57] ABSTRACT

A mechanical draft controller integrated in the draft hood of a furnace and coupled to a flue damper is responsive to the draft in the flue for controlling exhaust stack heat loss and eliminating heated room air loss via the draft hood under normal operating conditions. The pressure-sensitive controller is variably positioned as a face damper on a surface of the draft hood and is coupled to the flue damper by means of mechanical linkage. Increasing pressure in the draft hood caused by a reduction in the draft value due to partial flue blockage, large down draft, etc., displaces the pivoted controller resulting in a corresponding opening of the flue damper to re-establish the desired draft value. Similarly, excessive draft causes the displacement of the controller in an opposite direction resulting in flue damper displacement so as to reduce the draft value and exhaust stack heat loss. Between these two operating conditions the controller is variably positioned in the surface of the draft hood so as to block the escape of heated room air via the exhaust stack. A completely blocked flue resulting in an abnormal increase in pressure in the draft hood causes the controller to be further displaced resulting in the further displacement of the flue damper to a nearly completely open position to permit re-establishment of the desired draft value. Another safety feature provides for the breakage of the linkage coupling the draft controller with the flue damper in which case both dampers are automatically opened allowing the system to revert to normal draft hood operation. The draft hood control damper and the flue damper may be utilized in combination with a conventional bimetallic damper positioned downstream from the flue damper in reducing heat loss during burner OFF periods.

16 Claims, 2 Drawing Figures

MECHANICAL DRAFT CONTROLLER WITH VENT DAMPER

BACKGROUND OF THE INVENTION

This invention relates generally to furnace exhaust gas systems and more specifically is directed to an all-mechanical, self-operated draft controller for a fuel-burning appliance, or a furnace, which eliminates the heat loss of a conventional draft hood.

A draft hood is typically used in a conventional gas-fired appliance such as a furnace or a water heater. The draft hood generally includes a housing which couples the appliance's firebox with the flue pipe, or exhaust stack, by means of which the products of combustion from the firebox are safely vented to the atmosphere. In some installations, the draft hood may be positioned in the exhaust stack itself.

The conventional draft hood performs a variety of functions in a gas-fired appliance. It permits the escape of combustion products into the space adjacent the draft hood in the case of an excessive down draft or flue pipe or exhaust stack blockage beyond the draft hood. The draft hood also neutralizes the stack action of the chimney on the operation of the appliance by drawing air from the ambient and exhausting it through the chimney when the appliance is first fired. Thus, the draft hood plays an integral part in the initiation and sustaining of combustion in the appliance by controlling air flow in the firebox.

Draft hoods have long been known to also provide a readily available escape route for heated room air thus contributing to substantial heat loss in conventional gas-fired heating appliances. In the past, the low cost of fuel has mitigated against reducing draft hood heat loss or completely eliminating the draft hood. In addition, the safety and reliability provided by the conventional draft hood was particularly attractive in the residential environment.

Even with increasing fuel costs, the draft hood has remained an integral part of the conventional gas-fired heating appliance primarily because of its aforementioned attributes, i.e., safety, low cost and high reliability.

Today, however, much effort is being expended by heating appliance designers to reduce energy losses in general, and those attributable to the draft hood of the appliance in particular. In order to achieve higher energy efficiency based upon governmental standards, work is currently under way on the design and development of pulse burners, induced draft closed combustion chambers and other methods of eliminating draft hood losses. To date, these efforts have resulted in systems which are more expensive, noisier, and much less reliable than currently available draft hoods. Thus, there is currently a great need for a simple yet reliable, inexpensive yet energy efficient, independently self-actuated means for eliminating or substantially reducing the large energy loss characteristic of current draft hoods in conventional gas-fired heating appliances.

The present invention is intended to provide these advantages over a conventional draft hood and is easily installed, even by means of retrofit, in the typical residential gas-fired heating appliance.

SUMMARY OF THE INVENTION

The present invention includes a pressure-sensitive control damper in the front face of the draft hood of a furnace, or other fuel-burning appliance, for controlling the draft in the appliance's firebox. This face control damper eliminates the need for the normal opening in a conventional draft hood. The control damper is coupled by means of mechanical linkage to a draft damper positioned within the exhaust stack or flue pipe. Changes in exhaust stack draft cause variations in pressure within the draft hood, resulting in the displacement of the mechanically linked control and draft dampers. During normal operation the control damper remains closed eliminating room air draft hood heat loss while opening the draft damper for low draft values in providing for the the escape of increased amounts of combustion by-products and closing the draft damper for increasing draft values in reducing heat loss during burner OFF periods. Complete exhaust stack blockage or a large down draft resulting in a loss of draft causes the pivotally-mounted control damper to be further displaced to an open position and the coupled flue damper to be nearly completely opened for the re-establishment of the desired draft value. Excessive draft values cause the control damper to be oppositely displaced in positioning the draft damper across the exhaust stack to substantially reduce the draft value and virtually eliminate heat loss.

The present invention is entirely mechanical in structure, self-operated and responsive only to the environment in which it is placed. Breakage of the mechanical link coupling the control and draft dampers is safely accommodated for by pivoting the control damper and the draft damper to the full open position by means of weights attached to each damper, whereby the system operates similar to an appliance having a conventional draft hood with an opening therein. The control and draft dampers may be utilized in combination with a conventional temperature-sensitive damper element positioned downstream from the draft damper to further reduce heat loss during burner OFF periods.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, where like reference characters identify like elements in the several figures, in which:

DESCRIPTION OF THE PREFERRED EMBODIMENTS

Figure 1:
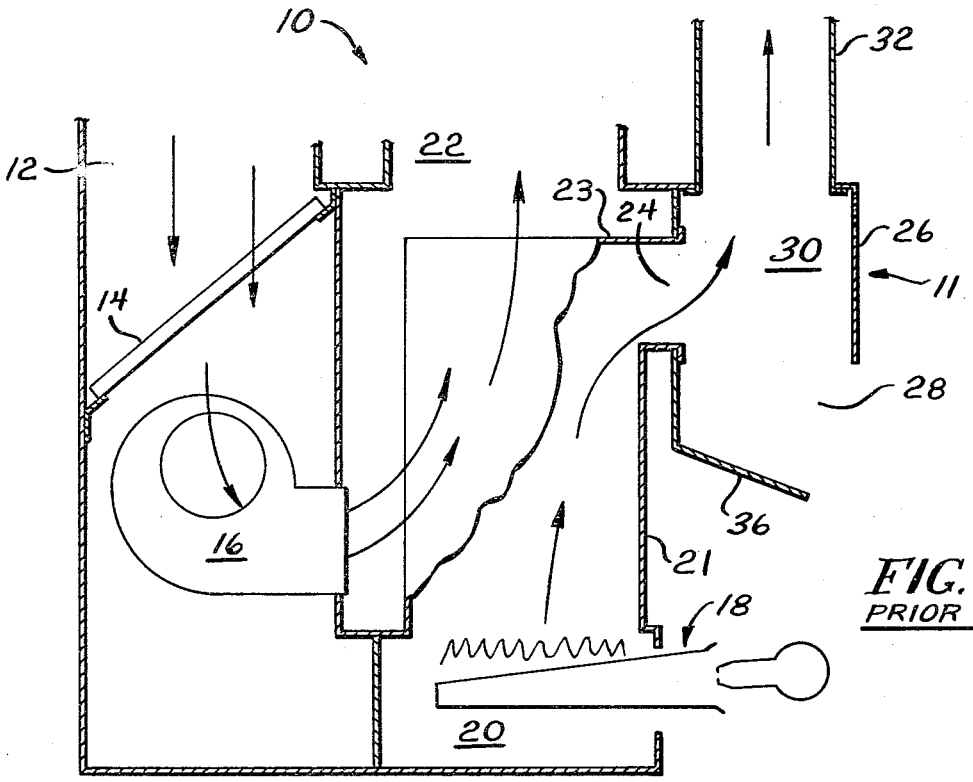
FIG. 1 PRIOR ART
FIG. 1 is a cross-sectional view of a conventional furnace having an open draft hood.

Referring to FIG. 1, there is shown a cross-sectional view of the configuration of a typical furnace 10 having a conventional draft hood 11. A blower 16 draws room air through a cold air return 12 and into firebox 20 as shown by the air flow arrows in FIG. 1. Particles and dirt are removed from the circulating air by means of a filter 14 located in, or adjacent to, the cold air return 12. After being directed into the firebox 20 by means of blower 16, the room air is then heated by means of burner 18 located in the lower portion of firebox 20. Firebox 20 is comprised of a housing defined by a plurality of walls including a side wall 21 and an upper wall 23.

Room air is circulated through firebox 20 by means of blower 16, the heated air exiting therefrom into either heated air duct 22 or flue gas exhaust aperture 24. The circulating air is typically heated by means of a plurality of heat exchanger clamshells located in the firebox 20 through which the air passes. This heat exchange arrangement, which is not shown in FIG. 2 since it does not form a part of the present invention, provides for the transfer of heat to the circulating air and the separation of the by-products of combustion from this heated air and their safe exhaust to the ambient. The hot air provided to duct 22 is then circulated again in the space being heated, with the exhaust gas of the combustion process transiting aperture 24 and entering draft chamber 30. This exhaust is then diluted by room air passing through draft hood aperture 28, and then escapes via the chimney (not shown) through the flue pipe 32. Draft chamber 30 is thus positioned between and connects firebox 20 with flue pipe 32 and is defined by an upper structural member 26 and a lower structural member 36 which, in combination with draft hood aperture 28, define the draft hood 11.

Referring to FIG. 1, in the case of a down draft or blockage in the flue pipe 32 or in the chimney (not shown) beyond the draft hood 11, the draft hood aperture 28 permits the escape of combustion products from the firebox 20 into the ambient, or the room adjacent furnace 10. The combustion area is thus isolated from the unwanted effects of these abnormal conditions. Draft hood 11 also facilitates fuel ignition when the appliance is first fired by providing an updraft through flue pipe 32 in counteracting the effect of excessive chimney stack action.

Figure 2:
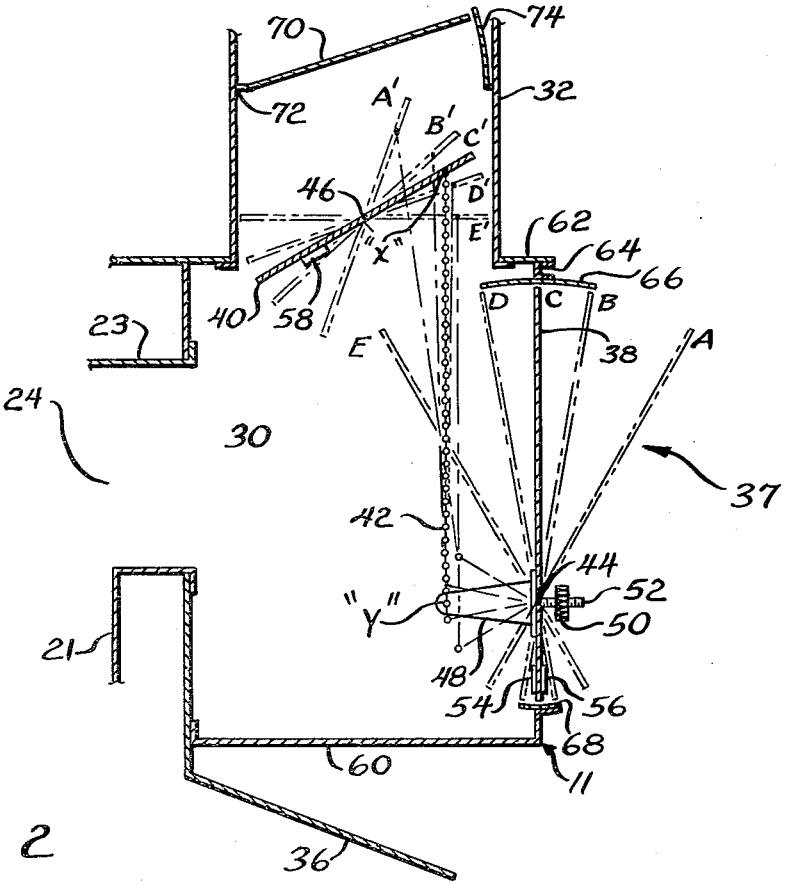
FIG. 2 is a cross-sectional view of a portion of FIG. 1 showing the modified draft hood installation including the combination of a control damper in the draft hood and a vent damper in the flue pipe in accordance with the present invention.

Referring to FIG. 2, there is shown a cross sectional view of a mechanical draft controller with vent damper 37 in accordance with a preferred embodiment of the present invention. An inlet wall 60 is coupled to and positioned on lower structural member 36 so as to span and block the draft hood aperture 28 in the prior art configuration of FIG. 1. In addition, upper structural member 26 is removed from draft hood 11 and is replaced by an extension housing 62 fixedly coupled to flue pipe 32 and tip shroud mount housing 64 rigidly affixed to extension housing 62. Positioned within the aperture thus formed by tip shroud mount housing 64 and inlet wall 60 is control damper 38. Control damper 38 is positioned and mounted therein by means of control damper pivot 44 which extends horizontally across the aperture defined by tip shroud mount housing 64 and inlet wall 60 and is mounted in a conventional manner to the facing walls (not shown) of the mechanical draft controller 37 which are parallel to the cross-sectional view of FIG. 2.

Attached to tip shroud mount housing 64 is upper tip shroud 66 while lower tip shroud 68 is attached to inlet wall 60. Thus, as shown in FIG. 2, upper and lower tip shrouds 66, 68 provide for the closure of the aperture therebetween over a range of positions of control damper 38 extending between positions B and D. With control damper 38 in position A or E, the aperture between the upper and lower tip shouds 66, 68 is, of course, unobstructed and air is free to pass in or out of draft chamber 30.

Control damper 38 is free to rotate about control damper pivot 44 with five of its continuously variable positions shown in FIG. 2. Under normal operating conditions, the control damper 38 is located between positions B and D. For an excessively high draft, control damper 38 assumes position E, while for a back draft in draft chamber 30, control damper 38 assumes position A. Position B, shown in dotted line form, represents the equilibrium position of control damper 38 with zero draft in draft chamber 30 where the pressure within draft chamber 30 is equal to the ambient pressure outside of the furnace. Position C of control damper 38 represents its position when the draft in draft chamber 30 is slightly less than the normal operating draft value. Position D of control damper 38 represents its position when the draft within draft chamber 30 is slightly above the normal operating draft value. Thus, control damper 38 will assume a position between C and D under ideal draft conditions. Positions A and E, also shown in dotted line form, respectively represent the positions of control damper 38 under abnormal operating conditions when a back draft occurs in draft chamber 30 and when the draft therein substantially exceeds the normal operating draft value. Thus, under normal operating conditions, control damper 38 is positioned across the aperture in draft hood 11 so as to eliminate the loss of heated room air via flue pipe 32.

Coupled to a lateral portion of control damper 38 immediately adjacent control damper pivot 44 is torque arm 48 which extends into draft chamber 30. Torque arm 48 tends to rotate control damper 38 in a counterclockwise direction. This moment is counterbalanced by means of vernier weight 50 movably positioned on threaded shaft 52 which is also affixed to control damper 38 immediately adjacent pivot 44 and on the opposite side thereof from torque arm 48. By selectively positioning vernier weight 50 along shaft 52, the orientation of control damper 38 may be calibrated to accommodate various draft values within draft chamber 30. In this manner, control damper 38 may be oriented in each of positions B, C and D over a great range of draft values within draft chamber 30. Also affixed to the inner and outer surfaces of a lower portion of control damper 38 are inner and outer positioning weights 54, 56, respectively. Inner and outer positioning weights 54, 56 act to counterbalance the off-center weight of control damper 38 and insure that control damper 38 is capable of maintaining a stable equilibrium position for a constant draft value in draft chamber 30.

Positioned within flue pipe 32 is draft damper 40 which is rotationally mounted on draft damper pivot 46. Draft damper pivot 46 extends generally horizontally and is perpendicular to the plane of the cross sectional view of FIG. 2 and is mounted on and coupled to lateral portions (not shown) of flue pipe 32 in a conventional manner. These lateral portions of the flue pipe are oriented generally parallel to the plane of the cross sectional view of FIG. 2. Draft damper 40 is thus free to rotate about pivot 46 and assume various positions within flue pipe 32. The various positions assumable by draft damper 40 are indicated by the letters A' through E', with positions A', B', D' and E'indicated in dotted line form.

A mechanical link, such as a chain 42, is connected to point "Y" on the distal portion of torque arm 48 and to an upper portion of draft damper 40 at point "X". In addition, attached to a lower portion of draft damper 40 is draft damper weight 58 which acts upon draft damper 40 so as to effect the counterclockwise rotation thereof. As can be seen in FIG. 2, by thus positioning damper weight 58 on draft damper 40 to effect the counterclockwise rotation thereof and by coupling the upper portion of draft damper 40 to the distal portion of torque arm 48 by means of chain 42, tension is maintained on chain 42. With tension thus maintained on chain 42, the rotational displacement of control damper 38 due to a pressure differential between the pressures within and without the draft chamber 30 will cause a corresponding, although oppositely directed, rotation of draft damper 40. This can be seen from the various positions, including those in dotted line form, A through E of control damper 38 and A' through E' of draft damper 40 where corresponding positions of the two damper elements are indicated by the same letter designations.

By considering the relative positions of control and draft dampers 38, 40 shown in FIG. 2, the operation of the mechanical draft controller 37 will now be explained. By selectively positioning vernier weight 50 along shaft 52, the positions of control and draft dampers 38, 40 may be calibrated to assume the positions of B and B', respectively, for a zero draft value in draft chamber 30 when the burner is off. With control damper 38 assuming a position between positions B and D under normal operating conditions with the burner in operation, draft damper 40 will similarly assume a position between positions B' and D' under these same conditions. In the case of a loss of draft in draft chamber 30, or the occurrence of a backdraft in the flue, both abnormal conditions, control damper 38 will assume position A, draft damper 40 will assume position A', and flue pipe 32 will be nearly fully opened. This will cause the desired draft value in draft chamber 30 to be re-established to support combustion in firebox 20 and to permit the venting of combustion by-products therefrom.

If the draft within draft chamber 30 is much greater than that which occurs under normal operating conditions, which may be caused by high winds, control damper 38 will assume position E, draft damper 40 will assume position E', and flue pipe 32 will be substantially closed permitting the draft therein to decrease to the desired draft value in providing for improved combustion and heater operation and a reduction in heat loss via flue pipe 32. Under this condition, vent damper 40 will be positioned across flue pipe 32. However, in actual practice the vent damper 40 is such a poor fit in the flue pipe 32 that the leakage past its edges is sufficient to permit an excessive stack draft to pull vent damper 40 to the closed position and still permit the escape of the products of combustion via flue pipe 32 while maintaining a pressure in draft chamber 30 below outside ambient. Positions A, E and A', E' thus represent extreme values for the draft within draft chamber 30 occurring only under abnormal operating conditions. Under normal conditions, control damper 38 will be located between positions B and D and draft damper 40 will correspondingly be located between positions B' and D'. With the burner in operation, control and vent dampers 38, 40 will assume positions between C, D and C', D', respectively. With the burner off, control and vent dampers 38, 40 will assume positions generally at B, B', respectively. Over this normal operating range of draft values control damper 38 prevents the loss of heated room air while vent damper 40 minimizes heat loss from the firebox 20 while maintaining an optimum position for the support of combustion therein. The draft value in the flue gas exhaust aperture 24 is thus maintained within tolerable limits under normal operating conditions.

In a preferred embodiment of the present invention, the unbalanced effective area of control damper 38 in a conventional residential furnace is 48 in.$^2$ having a lever arm with respect to chain 42 of 4 in. The draft within draft chamber 30 during normal operation is 0.015 in. of water below atmospheric pressure. With the flue blocked, the pressure in draft chamber 30 becomes a positive 0.015 in. above atmospheric pressure. This produces a torque of:

$$\frac{48.\ \text{in.}^2 \times 0.030\ \text{in. of } H_2O \times 4\ \text{in.} \times 16\ \text{oz./lb.}}{27.68\ \text{in. of } H_2O/\text{lb/in.}^2} = 3.3\ \text{in.-oz.}$$

This is more than 10 times the torque required to operate a balanced damper with good quality knife edge pivots as are commonly used in barometric dampers. The pivots 44 and 46 of both the control damper 38 and the draft damper 40 are of the knife edge type as are conventionally used in this type of heating appliance installation. By positioning these pivots in the lateral walls of the heating appliance, these knife edges may be positioned outside of the gas stream for more accurate and reliable operation.

Upper and lower tip shrouds 66, 68 allow control damper 38 to operate at position B with 0 draft, and at position C with −0.01 in. draft or position D with −0.02 in. draft, all with no loss of room air. By selectively positioning vernier weight 50, control damper 38 may be located at these various positions over a wide range of draft values, as desired.

Also shown in FIG. 2 is a temperature-responsive bimetallic vent damper 70 located downstream of draft damper 40 in flue pipe 32. Vent damper 70 is not essential for the proper operation of the mechanical draft controller of the present invention. However, when used in combination with mechanical draft controller 37 it further reduces heat loss via flue pipe 32. Vent damper 70 is affixed to an interior surface of flue pipe 32 by means of mounting base 72. Vent damper 70 operates in a conventional manner in opening or blocking flue pipe 32 depending upon the temperature therein for reducing flue pipe heat loss. Thus, during burner operation vent damper 70 bends upward to open flue pipe 32 in providing an escape for combustion by-products. During an OFF cycle, vent damper 70 is bent downward so as to close flue pipe 32 thus reducing flue pipe heat loss. Tip shroud 74 cooperates with vent damper 70 to close flue pipe 32 at temperatures elevated above the ambient temperature in order to further reduce heat loss via flue pipe 32. The mechanical draft controller 37 of the present invention will operate in combination with any conventional bimetallic flue damper. A description of the operation of the temperature responsive flue damper employed in conjunction with the mechanical draft controller of the present invention as shown in FIG. 2 is provided in co-pending patent application "Temperature Responsive Vent Damper", Ser. No. 300,034, filed Sept. 8, 1981, in the name of the present inventor, and assigned to the assignee of the present invention.

There has thus been described a mechanical draft controller integrated in the draft hood of a conventional furnace which does away with the normal opening in the draft hood and provides for improved furnace draft control and reduced room air heat loss. The mechanical draft controller is passive and self-operated and is capable of maintaining the draft in the draft hood within tolerable limits during normal operating conditions and of changing the draft therein during abnormal operating conditions so that the desired draft value may be reestablished.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. In a fuel burning heating appliance having a firebox and a flue for communicating combustion gases from said firebox to a chimney and including a housing having an aperture in a lateral surface thereof and coupling said firebox to said flue, a draft controller comprising: control means positioned in and coupled to said aperture and movably responsive to variations in the draft in said housing over a first range of positions, said first range of positions defined by first upper and lower draft values representing the range of draft vlues under normal operating conditions, said control means including the combination of a moveable control damper and a plurality of tip shrouds attached to said housing, each of said tip shrouds having a curved surface cooperating with said moveable control damper, wherein said aperture is closed by said control damper over the first range of positions thereby preventing the introduction of ambient air into said flue and wherein said control damper is movably responsive over a second, larger range of positions defined by second upper and lower draft values corresponding to draft values in said housing outside of said normal range of operation wherein said aperture is open when said first upper or lower draft values are exceeded; a second damper mounted in said flue downstream of said control means and variably positioned for controlling the draft therein, the position of said second damper continuously variable from a substantially closed position to a substantially open position and including a plurality of intermediate positions therebetween; and mechanical coupling means connecting said first damper and said control damper for variably positioning said second damper in response to the displacement of said control damper in controlling the draft value over said first range of positions of said control damper and for substantially closing or opening said flue when said first range of positions of said control damper defined by said first upper and lowr draft values are respectively exceeded, wherein said control damper is moveably responsive to the difference in pressure between a first pressure within said housing disposed upstream of said second damper and a second ambient pressure.

2. An apparatus as in claim 1 wherein said control damper is horizontally pivoted in the lateral surface of said housing.

3. An apparatus as in claim 2 wherein said control damper is displaced outward or inward relative to said lateral surface when the pressure within said housing is greater or less than said second ambient pressure outside of said housing, respectively.

4. An apparatus as in claim 3 wherein said second damper comprises a flat, solid member coupled to a horizontal shaft positioned in said flue with said flat, solid member free to rotate about said shaft in response to the displacement of said control damper.

5. An apparatus as in claim 4 wherein said mechanical coupling means comprises a chain for connecting said control and second dampers.

6. An apparatus as in claim 4 wherein said control and second dampers are each coupled to and supported by respective knife edge pivots for the free rotation thereof.

7. An apparatus as in claim 1 wherein said mechanical coupling means includes a flexible chain and said control damper and said second damper are rotationally biased in the same direction by first and second weights, respectively, with said flexible chain coupled therebetween so as to oppose the rotation of said control damper and said second damper whereby tension is maintained on said chain.

8. An apparatus as in claim 7 further comprising a third variably positioned weight coupled to said control damper for counterbalancing said first weight in calibrating the position of said control damper in said aperture for a predetemined draft in said housing.

9. An apparatus as in claim 2 wherein said control damper further includes a third weight positioned on a lower portion thereof for counterbalancing the off center weight of said control damper for positioning said control damper in a generally vertical direction when a differential pressure is not applied thereto.

10. An apparatus as in claim 3 wherein said plurality of tip shrouds include upper and lower tip shrouds mounted on the lateral surface of said housing on the respective upper and lower portions of said aperture and immediately adjacent the upper and lower edges of said control damper in providing for the closure of said aperture over said first range of positions of said control damper.

11. An apparatus as in claim 1 further including a temperature responsive damper positioned in said flue between said second damper and said chimney for closing said flue when the temperature therein is approximately equal to ambient temperature as when said heating appliance is OFF and for opening said flue means when the temperature therein exceeds said ambient temperature as when said heating appliance is ON.

12. An apparatus as in claim 11 further including structural means fixedly mounted in said flue and cooperatively positioned with respect to said temperature responsive damper for closing said flue at a predetemined temperature above said ambient temperature in reducing the heat loss through said flue.

13. An apparatus as in claim 1 wherein said first upper draft value occurs when said heating appliance is ON and said first lower draft value occurs when said heating appliance is OFF under normal operating conditions.

14. In a fuel burning heating appliance having a firebox, a flue and a draft hood coupling said firebox to said flue and having an aperture in a wall thereof, a method for maintaining an optimum draft value in said draft hood for supporting combustion in said firebox while reducing draft hood heat loss, said method comprising: closing said aperture over a predetermined range of normal operating draft values, said range defined by lower and upper draft value limits, and thereby preventing the introduction of ambient air into said draft hood; opening said aperture when said draft value is outside of said predetermined range; substantially opening said flue when said draft value is less than said lower draft value limit or substantially closing said flue when said draft value exceeds said upper draft value limit; and selectively opening and closing said flue downstream from said aperture over the predetermined range of normal operating draft values in response to changes therein, wherein said flue is more open when said heating appliance is operating at said lower draft value limit than when operating at said upper draft value limit.

15. The method of claim 14 further comprising closing said flue when the temperature therein approaches a first lower limit and opening said flue when the temperature therein approaches a second upper limit.

16. In a fuel burning heating appliance having a firebox, a flue and a draft hood coupling said firebox to said flue and including an aperture in a wall thereof, a method for increasing the efficiency of said heating appliance comprising: variably positioning in said aperture a first element in response to the draft value over a range of normal operating draft values in said draft hood defined by upper and lower draft value limits so as to obstruct said aperture and thereby prevent the introduction of ambient air into said draft hood; displacing said first element so as to open said aperture when the draft value in said draft hood is outside of said range of normal operating draft values; and regulating the draft in said flue downstream from said aperture in response to the draft value in said draft hood by substantially opening said flue when the draft value is substantially less than said range of normal operating draft values, substantially closing said flue when the draft value is substantially greater than said range of normal operating draft values and opening and closing said flue to a lesser extent when said draft value is within said range of normal operating draft values in maintaining the draft value within predetermined limits.

* * * * *